US006958699B1

(12) United States Patent
Karam

(10) Patent No.: US 6,958,699 B1
(45) Date of Patent: Oct. 25, 2005

(54) SIGNAL-DISRUPTION DETECTION IN POWERED NETWORKING SYSTEMS

(75) Inventor: Roger A Karam, Sunnyvale, CA (US)

(73) Assignee: Cisco Technology, Inc., San Jose, CA (US)

( * ) Notice: Subject to any disclaimer, the term of this patent is extended or adjusted under 35 U.S.C. 154(b) by 596 days.

(21) Appl. No.: 10/033,808

(22) Filed: Dec. 18, 2001

(51) Int. Cl.[7] ..... G08B 21/00
(52) U.S. Cl. ..... 340/650; 340/664; 340/286.02; 340/310.01
(58) Field of Search ..... 340/635, 650, 340/652, 657, 660, 661, 662, 663, 286.02, 340/286.03, 286.04, 310.01, 664; 700/286; 713/300

(56) References Cited

U.S. PATENT DOCUMENTS 5,237,511 A * 8/1993 Caird et al. ..... 702/58
5,742,513 A * 4/1998 Bouhenguel et al. ..... 700/286
5,790,391 A * 8/1998 Stich et al. ..... 363/24
5,991,885 A * 11/1999 Chang et al. ..... 713/300
6,233,128 B1 * 5/2001 Spencer et al. ..... 361/86
6,396,392 B1 * 5/2002 Abraham ..... 340/310.01

* cited by examiner

*Primary Examiner*—Van T. Trieu
(74) *Attorney, Agent, or Firm*—Thelen Reid & Priest LLP; David B. Ritchie

(57) ABSTRACT

Detecting a signal disruption of an AC-signal by a DC-current in a powered networking system includes receiving an AC-signal from the networking system; analyzing the AC-signal based on a predetermined characteristic of the AC-signal and generating an analysis output; then comparing the analysis output with a predetermined reference source wherein the comparing detects the AC-signal disruption in the powered networking system.

48 Claims, 7 Drawing Sheets

SIGNAL-DISRUPTION DETECTION IN POWERED NETWORKING SYSTEMS

FIELD OF THE INVENTION

The present invention is generally directed to telecommunication networks. More particularly, the present invention is directed to the detection of signal disruptions in network communication transmissions.

BACKGROUND OF THE INVENTION

The use of network communication media such as wires, twisted pair cables and fiber optics has long been known in the art. Presently, such media are in widespread use in establishing links among many types of networked devices in which two or more such devices are in need of communication with one another. As a result, such media allow for realization of sophisticated networked systems in which each member can communicate with other members and other devices linked to the network.

Such media have been developed in a wide variety of electro-optical manufacturing and conduit design configurations, depending upon the intended need at the implementation site. One form of network communication medium in use today is known as a powered network communication medium. A powered network communication medium is generally comprised of a traditional underlying communication medium, such as a 10BaseT, 100BaseTx or a 1000 Base T Ethernet connection pair for transmitting data signals usually in the form of an AC-signal, but in which a power signal is also supplied. The power signal is used to supply "phantom" power to the network devices which receive and/or transmit the data signal. In this way, the network device can be supplied with both the operational power and the data via a single transmission media such as a cable. One example of use of such a powered network communication medium is in the field of internet phones in which power may be supplied to the internet phone via an internet transmission medium such as an Ethernet cable. As with traditional telephones, this approach practically eliminates the need for a second cable supplying power to each phone.

While used in the art, the foregoing powered approach for supplying power across a network transmission medium is not without shortcomings. In powered networking, it is essential that the supplied power (usually a direct current (DC) signal) does not adversely interfere with the integrity of the transmitted data (a differential alternating current (AC) signal). Unfortunately, factors such as a magnetic saturation of the transmission medium due to unbalanced DC resistance may create interference with the AC-data-signal which may result in disruptions and corruption of the data carried by the AC-signal. In addition, the DC-interference is only one of numerous factors, such as bad connectors or cable, faulty components, software errors, and the like, that can result in degradation of the AC-signal, thus making it exceedingly difficult to identify the DC-current as the source of the disruption of the AC-signal.

It is therefore highly desirable to be able to correctly attribute a given AC-signal disruption to the supplied DC-current for conducting efficient diagnosis and subsequent repair. This however, has proven to be an ongoing challenge since no known method currently exists to efficiently and correctly check for factors such as saturation of the magnetic elements in powered networking systems so that repairs can be quickly focused in that direction.

The present invention introduces a novel detection technique to efficiently and correctly detect disruptions of AC-signals caused by the supplied DC-current in a DC-type phantom-powered networking system.

SUMMARY OF THE INVENTION

Detecting a signal disruption of an AC-signal by a DC-current in a powered networking system includes receiving an AC-signal from the networking system, analyzing the AC-signal based on a predetermined characteristic of the AC-signal and generating an analysis output, then comparing the analysis output with a predetermined reference source wherein the comparing detects the AC-signal disruption in the powered networking system.

The aforementioned summary description is intended to only provide an overview of the exemplary embodiments of the invention. A more detailed understanding of these features, and of additional features, and advantages of the invention will be provided to those skilled in the art from a consideration of the following Detailed Description of the Invention, taken in conjunction with the accompanying Drawings, which will now first be described briefly.

BRIEF DESCRIPTION OF THE DRAWINGS

The accompanying drawings, which are incorporated into and constitute a part of this specification, illustrate one or more exemplary embodiments of the invention, and together with the detailed description, serve to explain the principles and exemplary implementations of the invention.

In the drawings.

DETAILED DESCRIPTION OF THE INVENTION

Various exemplary embodiments of the invention are described herein in the context of detecting signal disruptions in network communication transmissions. Those of ordinary skill in the art will realize that the following detailed description of the invention is illustrative only and is not intended to be in any way limiting. Other embodiments of the invention will readily suggest themselves to such skilled persons having the benefit of this disclosure. Reference will now be made in detail to exemplary implementations of the invention as illustrated in the accompanying drawings. The same reference indicators will be used throughout the drawings and the following detailed descriptions to refer to the same or like parts.

In the interest of clarity, not all of the routine features of the exemplary implementations described herein are shown and described. It will of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Referring now more particularly to the Drawings, the invention is directed to detecting signal disruption of an AC-signal by a DC-current in a powered networking system.

Figure 1A:
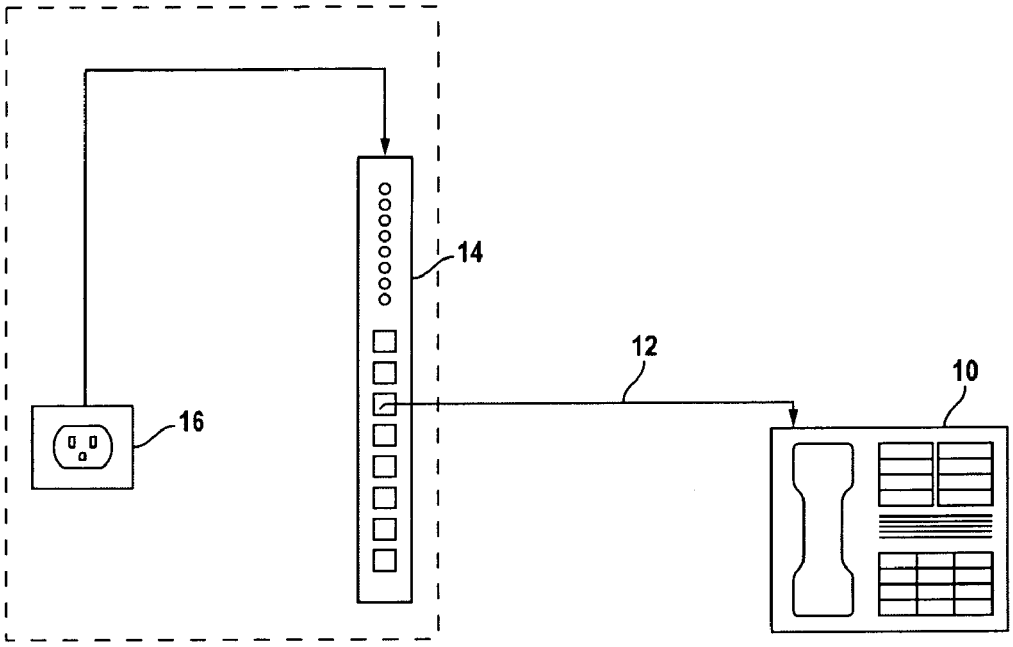
FIG. 1A is a physical layout of an exemplary implementation of the invention in a phantom-powered networking system.

FIG. 1A is a top-level view of an exemplary implementation in accordance with the invention as implemented in a powered networking system. As shown, a network powered device 10, such as a network powered telephone, is directly or indirectly connected to and supplied power by network access node 14 via a network communication medium, such as a powered 10BaseT Ethernet cable links 12. The network access node 14 is typically a network management device such as a network router or switch that is supplied with power from a power source 16 in a conventional way.

Figure 1B:
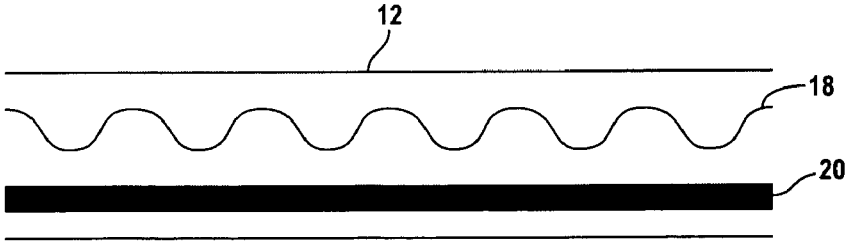
FIG. 1B is a simplified exemplary illustration of the dual current principle used in power networking.

FIG. 1B is a simplified exemplary illustration of dual current principles used in power networking. As shown, wire 12 represents a standard networking wire used as an electrical conduit to simultaneously relay both the power current 20 and the transmitted signal 18. Generally the power current 20 is a DC current used to supply operational power to a network powered device, while the transmitted signal 18 is typically an AC-data-signal which contains data. The AC-data signal typically comprises signal with frequencies exceeding 100 $KH_z$. As explained below and in greater detail, it is essential that the DC-current does not interfere with the integrity or the flow of the data transmitted in the AC-signal. Unfortunately, factors such as a magnetic saturation of the transmission medium due to unbalanced DC resistance creates an adverse interference with the AC-data-signal which generally results in disruptions and corruption of the data in the AC-signal.

Figure 2A:
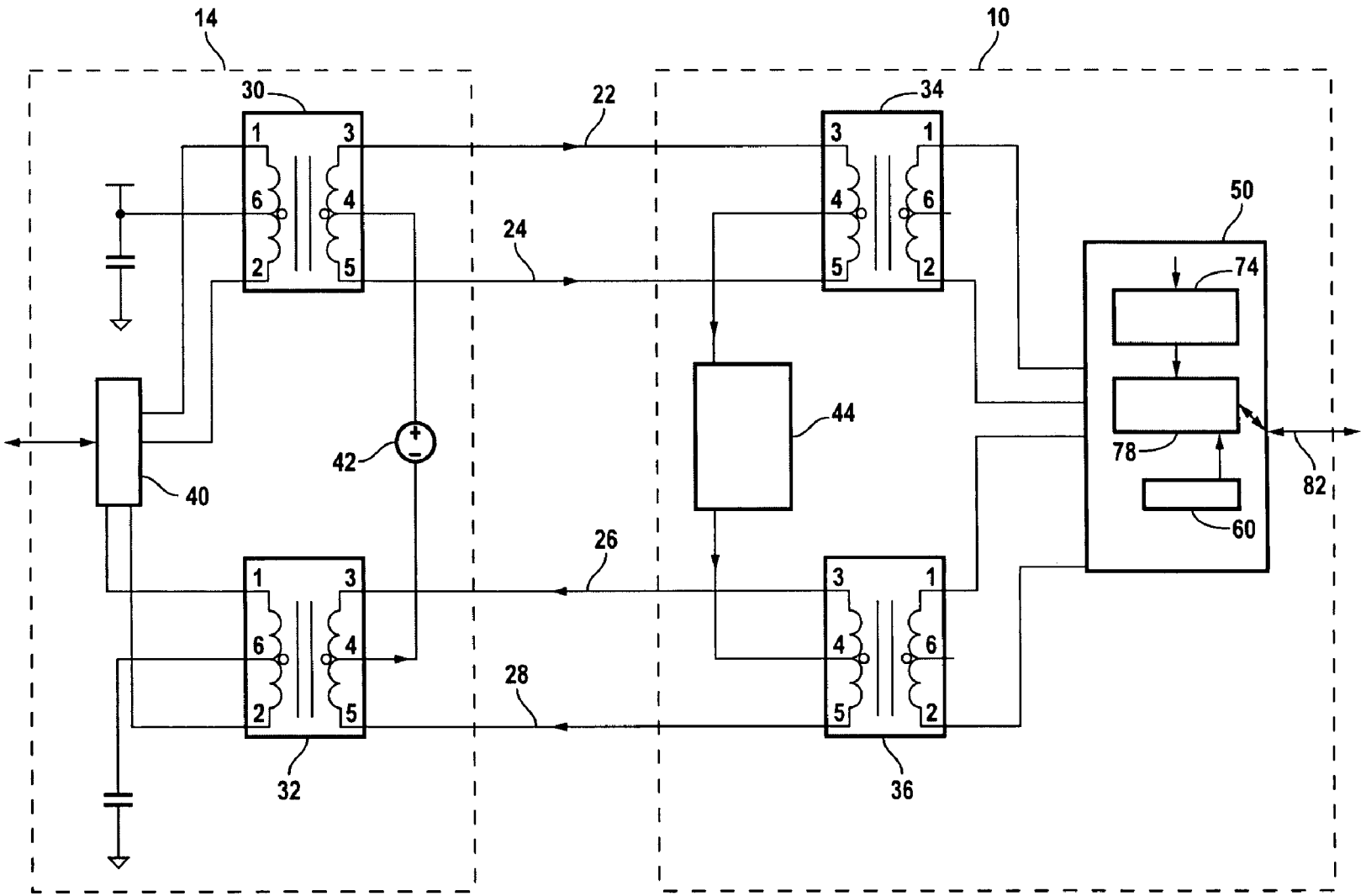
FIG. 2A is a combination circuit and block diagram further illustrating an exemplary implementation of the present invention as coupled to the power networking system shown in FIG. 1A.

FIG. 2A is a combination circuit and block diagram further illustrating the exemplary implementation of the invention as coupled to the powered networking system shown in FIG. 1A. As shown, data and power is transmitted from network node 14 to the network powered device 10 via a pair of communication media 22 and 24, and data is received from the network powered device 10 and power is transmitted from network node 14 to the network powered device 10 via another pair of communication media 26 and 28. Two pairs of signal transformers 30, 32 and 34, 36 located on the network node 14 and the powered network device 10, respectively, are used to transmit and receive data from across the communication media 22, 24, and 26, 28. In each signal transformer pair, one signal transformer is generally dedicated to transmission, such as signal transformer 30 in network node 14 and signal transformer 36 in powered network device 10, while the other signal transformer in each pair is generally dedicated to reception, such as signal transformer 32 in network node 14 and signal transformer 34 in powered network device 10. Each transmission signal transformer is also coupled to a reception signal transformer located across a communication medium, such as transmission signal transformer 30 and reception signal transformer 34. Additionally, each signal transformer pair is controlled by a driver unit, such as driver unit 40, whose functions include controlling the transmission and reception of data packets by the signal transformers across the communication mediums, and providing an interface with outside sources such as communication with other networks and human sources such as users and network personnel. In an exemplary embodiment, the driver unit is a conventional PHY-chip as is well known to those of ordinary skill in the art. Finally, the DC power source 42 provides the DC power across the communications media 22, 24, 26, 28 to the network powered device 10.

An exemplary operation of the overall diagram is as follows: data is received by driver unit 40, packetized and sent in the form of an AC-data-signal to transmission signal transformer 30. Transmission signal transformer 30 then includes the DC power current received from the DC power source 42 with the AC-data-signal via center taps supplying one polarity of the DC signal to media 22, 24 and the opposite polarity of the DC signal to media 26, 28 and transmits both over communication media 22 and 24 to the center tapped reception signal transformer 34 in networked powered device 10. Once received, the reception signal transformer 34 separates the DC-power-current from the AC-data-signal. The DC-power current is sent to provide power to the network device 10 represented in the form of load 44. The AC-data-signal is sent to the driver unit 50 for analysis in accordance with the present invention as described below. In an exemplary embodiment, the function of the driver units 40 and 50 include controlling the transmission and reception of data packets by the signal transformers across the communication media, and providing an interface with outside sources such as a human source communicating on the network powered telephone. Signals received from the outside source are then packetized by the driver unit 50 and sent in the form of an AC-data-signal to signal transformer 36, which in turn transmits the AC-data-signal to the reception signal transformer 32, and to the driver unit 40 for further transmission to the outside sources. Further details on operations of the driver unit 50 are provided in conjunction with FIG. 2C below.

Figure 2B:
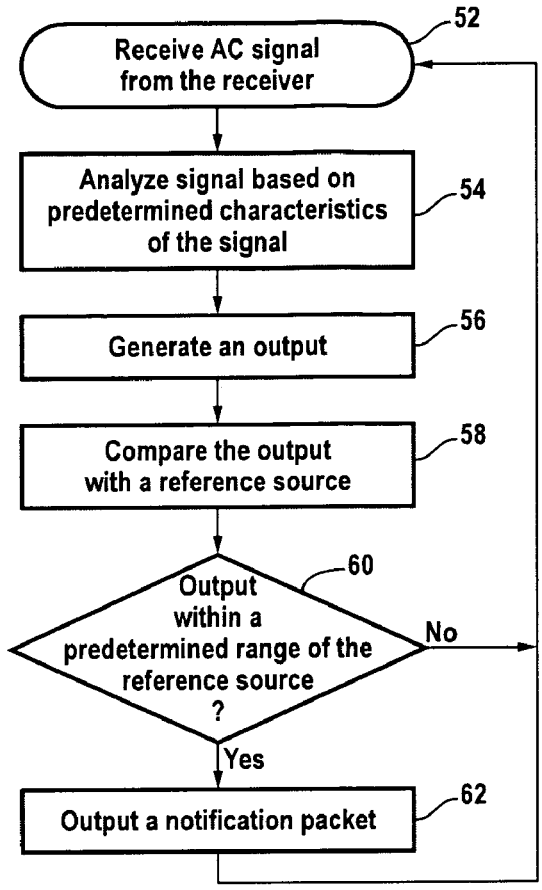
FIG. 2B is a flow chart illustrating operational stages of an exemplary embodiment of the invention.

FIG. 2B is a flow chart illustrating the operational flow of the exemplary embodiment of the invention shown in FIG. 2A. As shown at block 52, the AC-data-signal, first received in reception signal transformer 34 across communication mediums such as 22 and 24 in FIG. 2A, is again received in the driver unit 50. Next, in block 54 the AC-data-signal is analyzed based on predetermined characteristics of the signal which signify a DC-induced interference. In an exemplary embodiment, a predetermined characteristic is the drop in the amplitude of the transmitted AC-signal. Generally, during transmission across the communication media such as 22 and 24, the total amount of DC-current flow is equally balanced in the two media so that a desirable total DC-flux cancellation in the signal transformer can occur. This is why center-tapped transformers are used. A DC-induced interference may cause the foregoing equal balance and the total flux cancellations to be disrupted in favor of the DC-current in one medium, so that, for example, two-thirds of the total DC-current is transmitted across one medium in the pair and one third is transmitted across the other. This results in a drop in the AC-data-signal amplitude, which is detected in the analysis performed in block 54. In block 56, an analysis output is generated, indicating the degree of presence of any detected predetermined characteristics in the signal. In an exemplary embodiment, this output will indicate the degree in the drop of the amplitude of the AC-data-signal.

Next, in block 58, the analysis output is compared to a reference source. In an exemplary embodiment, this reference source is a predetermined amplitude or the drop in amplitude of an AC-data-signal signifying a DC-induced interference in the communication medium. In the decision block 60, if an analysis output result is not within a predetermined range of the reference source, signifying no DC-induced interference, then the flow returns to block 52 at where a newly received AC-data-signal will be analyzed in the manner explained above. If however, the analysis output result are found to be within a predetermined range of the reference source, signifying a DC-induced interference, then the flow proceeds to block 62 where a signal or a notification packet regarding the DC-induced interference is output, such as to a system administrator or a software application. The flow then returns to block 52 where a newly received AC-data-signal will be analyzed in the manner explained above.

In an alternative exemplary embodiment, at block 52, instead of the AC-signal, a low frequency pulse may be transmitted across a medium, such as 22, and then received so as to detect signal disruptions in the transmission medium. The low frequency pulse is transmitted at a frequency range that is within the passband of the signal transformers, such as a 1 microsecond pulse, where the transmission media have minimal attenuation, so that the magnetic saturation does not impede the reception of the low frequency pulse at the receiving signal transformer.

Figure 2C:
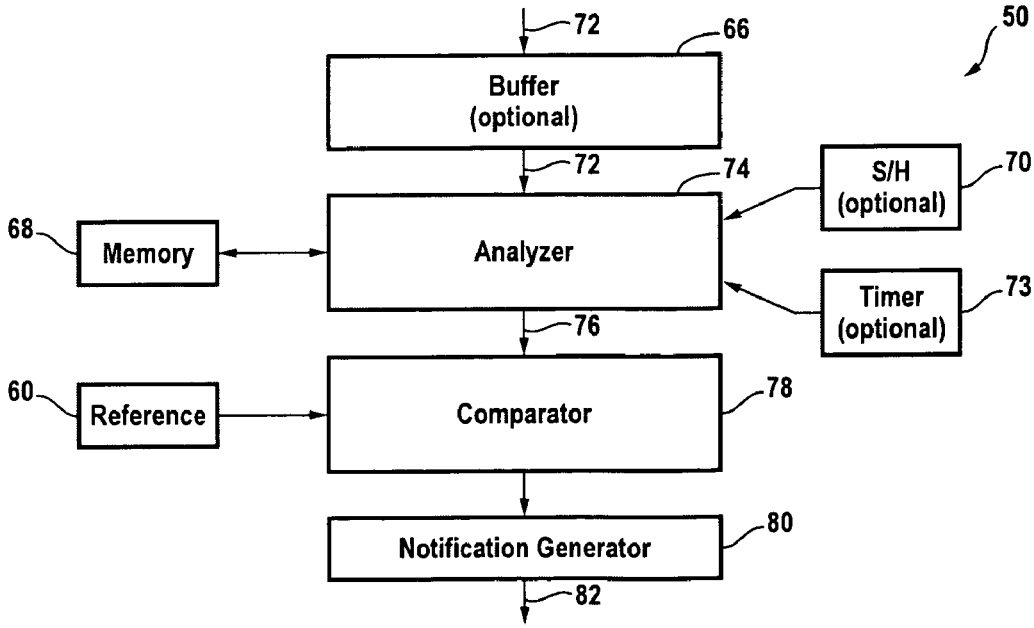
FIG. 2C is a block diagram further illustrating various exemplary features of the invention.

FIG. 2C is a block diagram further illustrating the various exemplary features of the driver unit 50 introduced in conjunction with FIG. 1A. As shown in FIG. 2C, the AC-data-signal 72 is received in the analyzer unit 74. In an exemplary embodiment the analyzer unit 74 is a conventional peak detector coupled to a conventional sample and hold circuit 70. The analyzer unit 74 next transmits an analysis output 76 to the comparator 78. The comparator 78 then compares the analysis output 76 with the reference source 60, such as a reference voltage, to determine whether a DC-induced interference has occurred, in which case the notification generator 80 is instructed to generate a notification packet 82 regarding the DC-induced interference and to output the notification, such as to a system administrator or a software application.

In an exemplary embodiment, the AC-data-signal 72 is first received in a buffer 66, for subsequent forwarding to and use by the analyzer unit 74. The analyzer unit 74 can also be provided with a memory unit 68 for storage and retrieval of the analysis output 76 and other instructions. In an exemplary embodiment, the memory unit 68 is a programmable memory unit such as an Electronic Erasable Programmable Read Only Memory so that data can be both stored and retrieved. In addition, the analyzer unit 74 is also a programmable analyzer unit 74 so that the analysis criteria can be programmed into the unit. Other embodiments include a sample and hold circuit 70 and timer unit 73 in operative communication with analyzer unit 74 so that the analysis can be conducted at predetermined times and/or the results are sampled and held at particular times. One advantage of the foregoing feature of the present invention is that by conducting the analysis at predetermined times during which a sample is obtained and held, the processing and output times can be advantageously reduced without practically comprising the accuracy of the analysis.

Figure 3A:
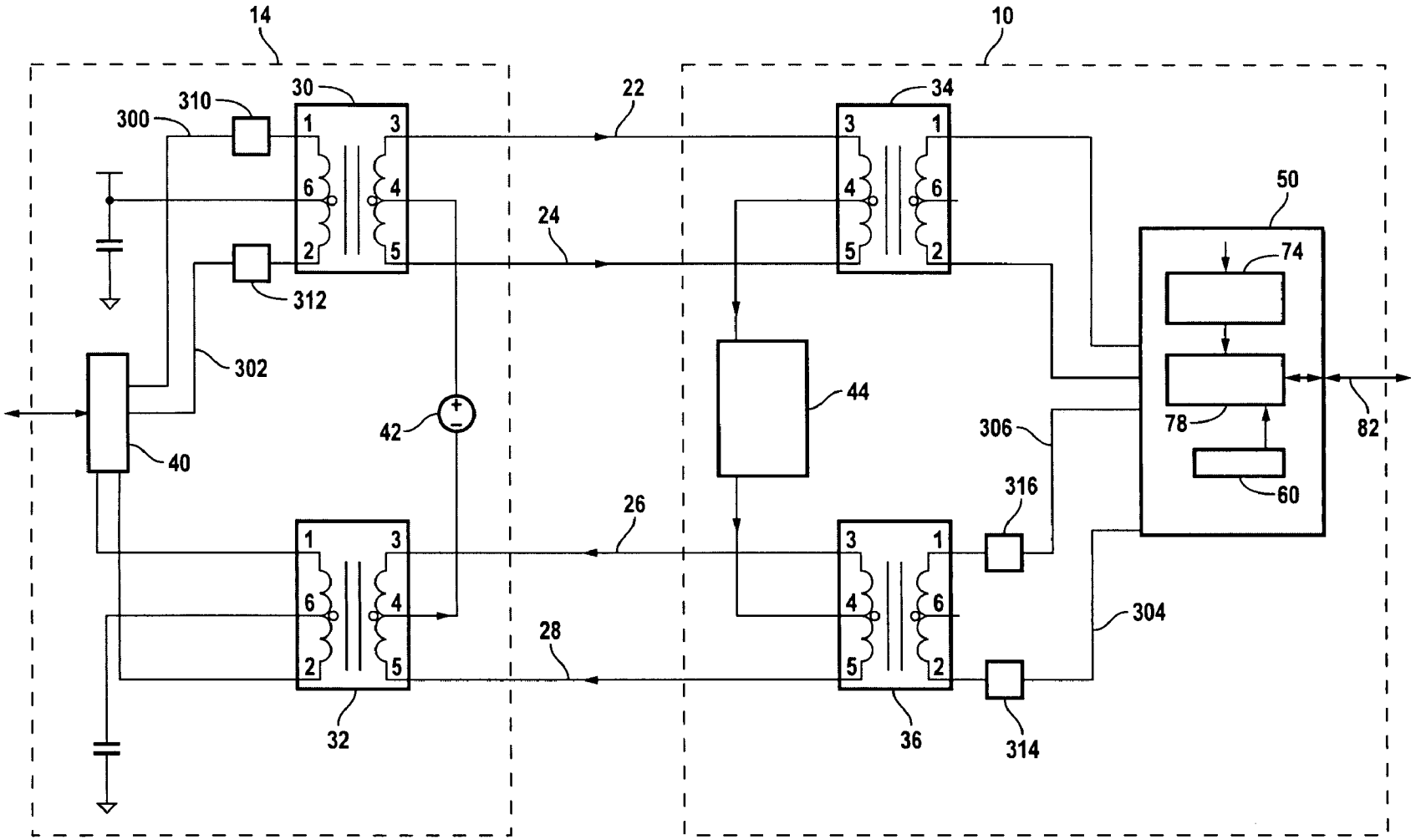
FIG. 3A is a combination circuit and block diagram illustrating another exemplary implementation of the invention as coupled to the power networking system shown in FIG. 1A.

FIG. 3A is a combination circuit and block diagram illustrating another exemplary implementation of the invention as coupled to the power networking system shown in FIG. 1A. Several circuit components that are common to the power networking system were previously discussed in conjunction with FIG. 2A, so only the different elements and arrangements will be discussed herein. In addition, the same reference indicators of FIG. 2A have been used throughout FIG. 3A and the following detailed descriptions to refer to the same or like parts shown in FIG. 2A.

In the exemplary embodiment shown in FIG. 3A, a pair of signal-monitoring devices monitor the AC-data-signal transmitted from a driver unit to a transmission signal transformer via transmission mediums. As shown in FIG. 3A, a pair of signal-monitoring devices 310 and 312 monitor the AC-data-signal transmitted from the driver unit 40 to the transmission signal transformer 30 via transmission mediums 300 and 302. Similarly, a pair of signal-monitoring devices 314 and 316 monitor the AC-data-signal transmitted from the driver unit 50 to the transmission signal transformer 36 via transmission mediums 304 and 306.

An exemplary operation of the overall diagram is as follows: data is received by driver unit 40, packetized and sent in the form of an AC-data-signal to transmission signal transformer 30 across communication mediums 300 and 302. Signal-monitoring devices 310 and 312 monitor characteristics of the AC-data-signal across the signal transformer 30. Each signal monitoring device 310 and 312 is in communication with driver unit 40, either across communication mediums 300 and 302 or by other means so that driver unit 40 can be provided with the monitoring data of each of monitoring devices 310 and 312. In an exemplary embodiment, the monitoring devices are located within the driver units or comprise of existing circuitry within the driver units set to the new use of monitoring the characteristics of the AC-data-signal across the signal transformers. The received AC-data-signal is then included with a received DC-signal in the manner described in FIG. 2A and transmitted to the driver unit 50. Similarly for driver unit 50, signals received from outside sources are packetized by the driver unit 50 and sent in the form of an AC-data-signal to transmission signal transformer 36 across communication mediums 304 and 306. Signal-monitoring devices 314 and 316 monitor characteristics of the AC-data-signal prior to its reception in the signal transformer 36. Each signal monitoring device 314 and 316 is in communication with driver unit 50, either across communication mediums 300 and 302 or by other means so that driver unit 50 can be provided with the monitoring data of each of monitoring devices 314 and 316. The signal transformer 36 then, in turn, transmits the AC-data-signal to the reception signal transformer 32, and to the unit 40 for further transmission to the outside sources. Further details on operations of driver units 40 and 50 in the embodiment shown in FIG. 3A are provided in conjunction with FIG. 3C below.

Figure 3B:
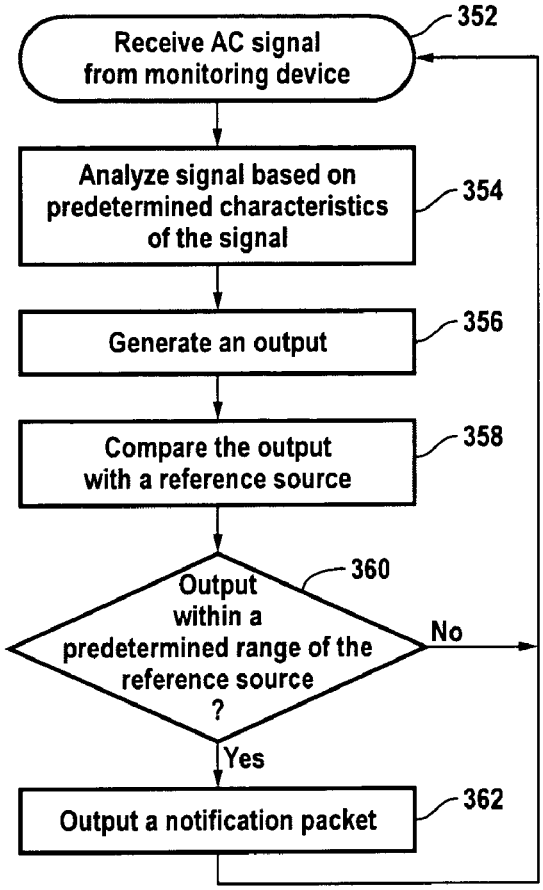
FIG. 3B is a flow chart illustrating operational stages of the exemplary embodiment of the present invention as shown in FIG. 3A.

FIG. 3B is a flow chart illustrating operations of the exemplary embodiment of the invention shown in FIG. 3A. As shown, at block 352 the AC-data-signal, first transmitted by the driver unit 40 to signal transformer 30 across a pair of communication mediums such as 300 and 302 in FIG. 3A, is subsequently received in a monitoring device, such as monitoring device 310 or 312. Next, in block 54 the AC-data-signal is analyzed based on predetermined characteristics of the signal which signify a DC-induced interference. In an exemplary embodiment, a predetermined characteristic is the drop in the amplitude of the transmitted AC-signal. Generally, during transmission across the communication media such as 22 and 24, the total amount of DC-current flow is equally balanced between the two media so that a desirable total DC-flux cancellation in the signal transformer can occur. A DC-induced interference will cause the foregoing equal balance and the total flux cancellations to be disrupted in favor of the DC-current in one medium, so that for example two-thirds of the total DC-current is transmitted across one medium in the pair and one third is transmitted across the other. This results in a drop in the AC-data-signal amplitude. In addition, the DC-induced interference in communication mediums 22 and 24 also adversely affect the AC-data-signal transmitted across communication mediums 300 and 302, respectively, and which can be detected in the analysis performed in block 354. In block 356, an analysis output is generated, indicating the degree of presence of any detected predetermined characteristics in the signal. In an exemplary embodiment, this output will indicate the degree in the drop of the amplitude of the AC-data-signal.

Next, in block 358, the analysis output is compared to a reference source. In an exemplary embodiment, this reference source is a predetermined amplitude or the drop in amplitude of an AC-data-signal signifying a DC-induced interference in the communication medium. In the decision block 360, if an analysis output result is not within a predetermined range of the reference source signifying no DC-induced interference, then the flow returns to block 352 at where a newly received AC-data-signal will be analyzed in the manner explained above. If however, the analysis output result are found to be within a predetermined range of the reference source, signifying a DC-induced interference, then the flow proceeds to block 362 where a notification packet regarding the DC-induced interference is outputted, such as to a system administrator or a software application. The flow then returns to block 352 where a newly received AC-data-signal will be analyzed in the manner explained above.

In another exemplary embodiment, an AC-data-signal is first transmitted across the communication media 22 and 24 prior to the application of the DC-current. The amplitude of this AC-data-signal is then recorded as the reference source to be compared against subsequently received AC-data-signal transmitted after the application of DC-current. One advantage of the forgoing approach is that the reference source will then already include any possible pre-existing form of non-DC induced interference such as bad connectors or cable, faulty components, software errors and the like, that can result in adverse interference with the AC-signal. In this way, a new interference subsequent to the application of the DC-current can be more easily attributed to the application of the DC-current and therefore more efficiently addressed.

Figure 3C:
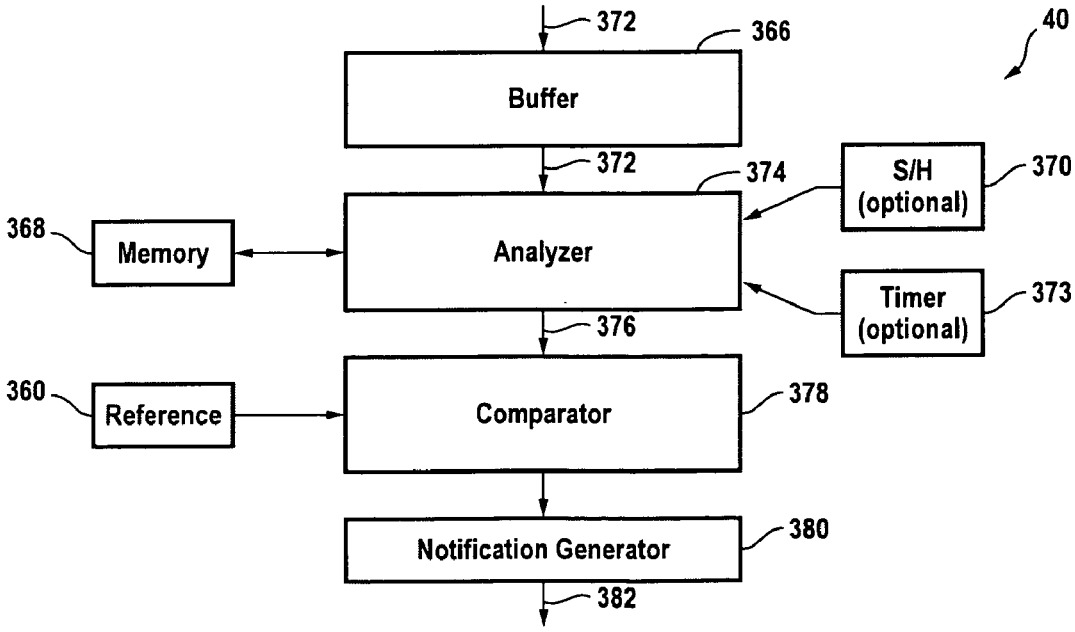
FIG. 3C is a block diagram further illustrating various exemplary features of the present invention as shown in FIG. 3A.

FIG. 3C is a block diagram further illustrating the various exemplary features of the invention as shown in FIG. 3A. As shown in FIG. 3C, the AC-data-signal 372 is received in the analyzer unit 374. In an exemplary embodiment the analyzer unit 374 is a peak detector coupled to a sample and hold circuit 370. The analyzer unit 374 next transmits an analysis output 376 to the comparator 378. The comparator 378 then compares the analysis output 376 with the reference source 360, such as a reference voltage from recorded from specification parameters or from a read out of the AC-data-signal prior to the application of the DC-current, to determine whether a DC-induced interference has occurred, in which case the notification generator 380 is instructed to generate a notification packet 382 regarding the DC-induced interference and to output the notification, such as to a system administrator or a software application.

Figure 4:
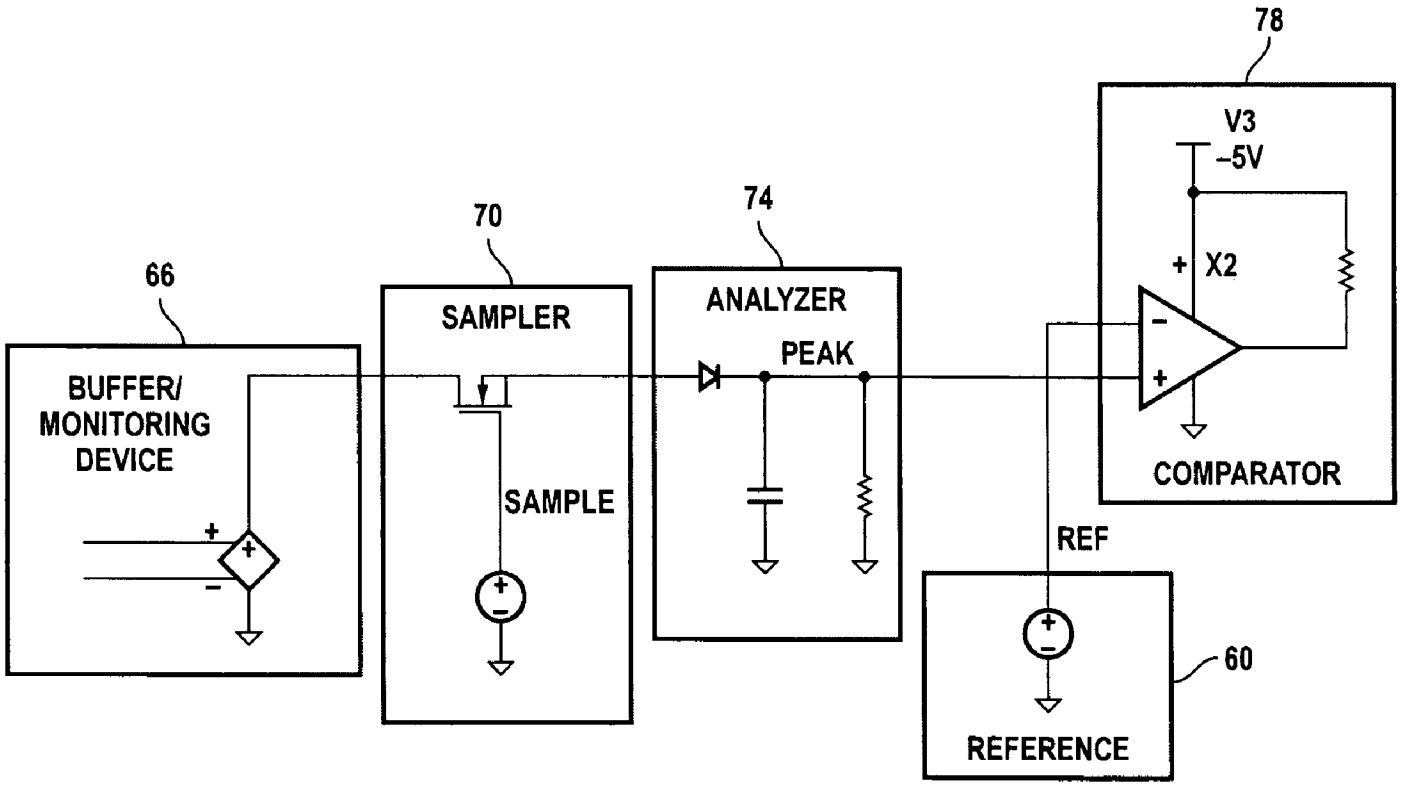
FIG. 4 is a circuit diagram further illustrating an exemplary implementation of the present invention.

FIG. 4 is a circuit diagram further illustrating an exemplary implementation of the invention. As shown, the buffer or monitoring device 66 is in operative communication with the sample and hold circuit 70, which, in turn, is in operative communication with the analyzer 74 and the comparator 78 which are, in turn, in operative communication with the reference source 60. In an exemplary embodiment, the monitoring device 66 is a high speed operation amplifier (op amp) with a gain of one. In addition, the analyzer unit 74 is a peak detector coupled to the sample and hold circuit 70.

Figure 5A:
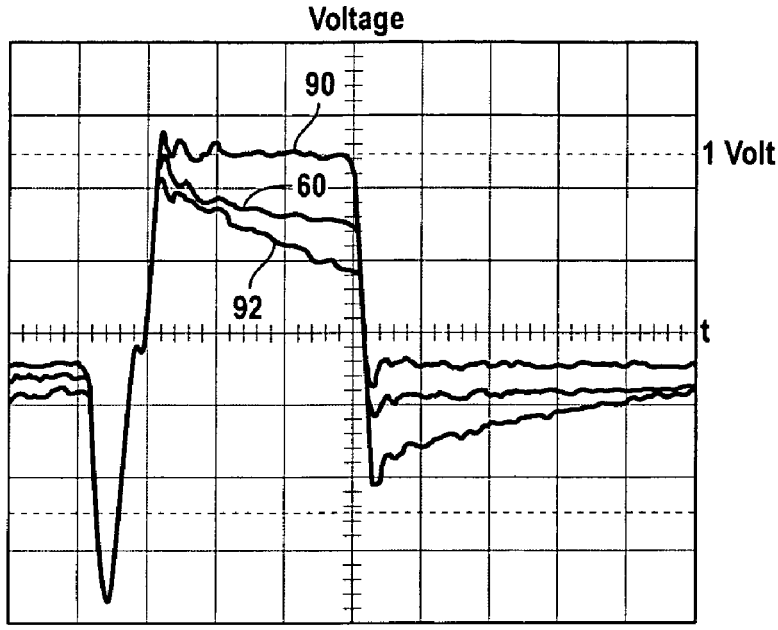
FIG. 5A is a voltage oscillation graph illustrating the operations of an exemplary embodiment of the present invention.

FIG. 5A is a voltage oscillation graph illustrating the operations of an embodiment of the present invention. The waveform 90 represents an exemplary AC-data-signal transmitted across a communication medium with an amplitude associated with no DC-induced interference, such as one volt. Waveform 60 represents the reference voltage level, such as 0.8 volts, a voltage drop to a level below which is associated with a DC-induced interference. As shown, the waveform 90 is at 1.0 volt and therefore above the reference level 60 of 0.8 volts and thus no notification output would result. Once a DC-induced interference occurs, the amplitude of the AC-data-signal drops, such as that represented by waveform 92, which has fallen to below the reference level 60 such as 0.6 volts. This condition is associated with a DC-induced interference in the AC-data-signal, resulting in the generating and outputting of a notification packet.

Figure 5B:
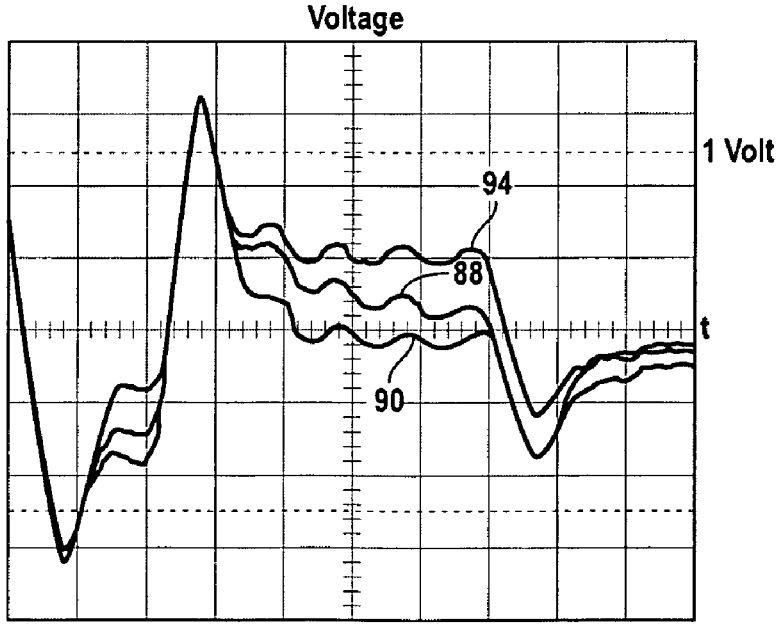
FIG. 5B is another voltage oscillation graph illustrating the operations of an alternate embodiment of the present invention.

FIG. 5B is another voltage oscillation graph illustrating the operations of an alternate embodiment of the invention. In the embodiment shown, analysis of the AC-data-signal waveform 94 is based on the energy area underneath the waveform 94. The reference waveform 88 is likewise represented in the form of the energy area encompassed under the waveform 88, which is then used as a reference energy level. Once a DC-induced interference occurs, the energy level of the AC-data-signal 94 drops, a such as that represented by the area beneath waveform 96, which has fallen to below the reference energy level 88. This condition is associated with a DC-induced interference in the AC-data-signal, resulting in the generation and output of a notification packet or other appropriate signal.

Other embodiments of the invention include but are not limited to incorporation of a programmable comparator, the use of EEPROMs for memory, the use of digital signal processing (DSP) techniques to analyze the signals, additional number of communication media analyzed, and associated hardware and software capabilities for achieving the same. It should be noted that the various features of the foregoing embodiments were discussed separately for clarity of description only and they can be incorporated in whole or in part into a single embodiment of the present invention having all or some these features.

It should also be noted that a low-frequency (e.g., 50–60$H_z$) AC power signal may be substituted for the DC power signal used herein and in virtually all respects the invention would operate in a similar manner. In some applications AC power is preferred to DC power because it will operate even if media polarity is reversed. Accordingly, in the claims, the references to DC are intended to include low frequency AC power signals (those that can be easily filtered from the data signal with a low pass filter and which have a frequency less than that of the lowest frequency of the frequency spectrum associated with the data signal.

Other embodiments, features, and advantages of the invention will be apparent to those skilled in the art from a consideration of the foregoing specification as well as through practice of the invention and alternative embodiments and methods disclosed herein. Therefore, it should be emphasized that the specification and examples are exemplary only, and that the true scope and spirit of the invention is limited only by the following claims.

What is claimed is:

1. A detector system for detecting a signal disruption of an AC-signal by a DC-current in a powered networking system, said system comprising:

a signal analyzer subsystem in operative electrical communication with said powered networking system, said analyzer adapted to receive said AC-signal from said networking system and to analyze said AC-signal based on a predetermined characteristic of said AC-signal and to generate an analyzer output; and a comparator subsystem in operative electrical communication with said analyzer subsystem, said comparator adapted to receive and to compare said analyzer output with a predetermined reference source so as to detect an AC-signal disruption and determine if said AC-signal disruption is caused by the DC current.

2. A system according to claim 1, wherein said comparator generates a comparator output.

3. A system according to claim 2 further comprising:

a notification subsystem in operative electrical communication with said comparator subsystem and adapted to receive said comparator output and to notify at least one of a human and a device based on said comparator output.

4. A system according to claim 3, wherein said predetermined reference is at least one of a predetermined reference voltage amplitude and a predetermined reference energy charge.

5. A system according to claim 4, wherein said predetermined reference is a voltage in a range of about 0.7 volts to about 5.0 volts.

6. A system according to claim 4, wherein said comparison determines if said registered characteristic of said AC-signal is outside a predetermined range of said reference, thereby signifying the existence of an AC-signal disruption in said powered networking system.

7. A system according to claim 4, wherein said comparator generates said comparator output if said registered characteristic of said AC-signal is outside a predetermined range of said reference.

8. A system according to claim 3, wherein said notification subsystem notifies said at least one of said human and said device by at least one of an LED unit flashing in a predetermined sequence, and a software notification packet transmitted to a predetermined location.

9. A system according to claim 1, wherein said AC-signal is received from at least one of a transmitter end and a receiving end of said powered networking system.

10. A system according to claim 9, wherein said powered networking system utilizes twisted pair conductors as its signaling medium.

11. A system according to claim 9, further comprising:

a data-relay subsystem adapted to transmit said AC-signal from a first signal-transformer to a second signal transformer, said first signal transformer adapted to receive said AC-signal from said data-relay subsystem and the DC-current from a DC-power source and to transmit said AC-signal along with the DC-current to said second signal transformer, wherein said signal analyzer subsystem receives said AC-signal from said first signal transformer subsequent to said transmission by said data-relay subsystem and prior to said reception in said second signal-transformer.

12. A system according to claim 1, wherein said predetermined characteristic of said AC-signal is a voltage amplitude of said AC-signal.

13. A system according to claim 12, wherein said analyzer is at least one of an analog analyzer and digital analyzer adapted to measure said predetermined characteristic of said AC-signal.

14. A system according to claim 12, wherein said at least one of an analog analyzer and digital analyzer is adapted to register said measured predetermined characteristic of said AC-signal for subsequent retrieval.

15. A system according to claim 14, wherein said analog analyzer registers said measured predetermined characteristic of said AC-signal in an analog storage medium.

16. A system according to claim 14, wherein said registration in said analog storage medium stores of a voltage corresponding to said measured predetermined characteristic of said AC-signal in a electrical capacitor for subsequent retrieval.

17. A system according to claim 14, wherein said digital analyzer digitally registers said digitally measured predetermined characteristic of said AC-signal in a digital storage medium.

18. A system according to claim 14, wherein said registration in said digital storage medium is storage of a computer readable value corresponding to said measured predetermined characteristic of said AC-signal on a computer readable memory medium.

19. A system according to claim 14, wherein said analyzer output includes at least one of said measured and said registered predetermined characteristic of said AC-signal.

20. A system according to claim 14, wherein said analyzer is adapted to conduct at least one of said measurement and registration of said predetermined characteristic at predetermined time intervals.

21. A system according to claim 20, further comprising:

a timer subsystem in operative electrical communication with said analyzer subsystem, said timer subsystem adapted to provide said analyzer subsystem with said predetermined time intervals.

22. A system according to claim 21, wherein said timer subsystem is programmable to adjust the periodicity of said predetermined time intervals.

23. A system according to claim 20, wherein each of said predetermined time intervals is a time interval in a range of about 20 nanoseconds to about 280 nanoseconds.

24. A system according to claim 1, wherein said AC-disruptions are caused by a magnetic saturation in said powered networking system wherein said magnetic saturation is induced by said DC-current.

25. A method for detecting a signal disruption of an AC-signal by a DC-current in a powered networking system, said method comprising:

receiving an AC-signal from said networking system;

analyzing said AC-signal based on a predetermined characteristic of said AC-signal generating an analysis output responsive to said analyzing; and comparing said analysis output with a predetermined reference source to detect said AC-signal disruption in the powered networking system and determine if said AC-signal disruption is caused by the DC current.

26. A method in accordance with claim 25, wherein said AC-signal is received from at least one of a transmitter end and a receiving end of said powered networking system.

27. The method in accordance with claim 26, wherein said receiving said AC-signal at a transmitter end further comprises:

transmitting said AC-signal from a data-relay subsystem to a first signal-transformer, said first signal transformer receiving said AC-signal from said data-relay subsystem and said DC-current from a DC-power source, receiving said AC-signal subsequent to said transmitting by said data-relay subsystem and prior to said reception in a second signal-transformer.

28. A method in accordance with claim 25 further comprising:

generating a comparison output; and notifying at least one of a human and a device based on said comparison output.

29. A method in accordance with claim 28, wherein said analyzing further comprises:

storing said measured predetermined characteristic of said AC-signal for subsequent retrieval.

30. A method in accordance with claim 29, wherein said storing includes:

storing a voltage corresponding to said measured predetermined characteristic in a capacitor.

31. A method in accordance with claim 29, wherein said analyzing takes place at predetermined time intervals.

32. A method in accordance with claim 31 further comprising:

providing predetermined time intervals.

33. The method in accordance with claim 28, wherein said AC-signal disruptions are caused by magnetic saturation in said powered networking system wherein said magnetic saturation is induced by said DC-current.

34. A method in accordance with claim 25, wherein said predetermined characteristic of said AC-signal is at least one of a voltage amplitude and a corresponding energy charge of said AC-signal.

35. A method in accordance with claim 25, wherein said comparing determines if said predetermined characteristic of said AC-signal is outside a predetermined range so that there is AC-signal disruption in said powered networking system.

36. An apparatus for detecting a signal disruption of an AC-signal by a DC-current in a powered networking system, said apparatus comprising:

means for receiving an AC-signal from said networking system;

means for analyzing said AC-signal based on a predetermined characteristic of said AC-signal generating an analysis output responsive to said analyzing; and means for comparing said analyzing output with a predetermined reference source to detect said AC-signal disruption and determine if said AC-signal disruption is caused by the DC current in the powered networking system.

37. An apparatus in accordance with claim 36, wherein said AC-signal is received from at least one of a transmitter end and a receiving end of said powered networking system.

38. The apparatus in accordance with claim 37, wherein said receiving said AC-signal at a transmitter end further comprises:

means for transmitting said AC-signal from a data-relay subsystem to a first signal-transformer, said first signal transformer receiving said AC-signal from said data-relay subsystem and said DC-current from a DC-power source, means for receiving said AC-signal subsequent to said transmitting by said data-relay subsystem and prior to said reception in a second signal-transformer.

39. An apparatus in accordance with claim 36 further comprising:

means for generating a comparison output; and means for notifying at least one of a human and a device based on said comparison output.

40. An apparatus in accordance with claim 39, wherein said analyzing further comprises:

means for storing said measured predetermined characteristic of said AC-signal for subsequent retrieval.

41. An apparatus in accordance with claim 40, wherein said storing includes:

means for storing a voltage corresponding to said measured predetermined characteristic in a capacitor.

42. An apparatus in accordance with claim 40, wherein said analyzing takes place at predetermined time intervals.

43. An apparatus in accordance with claim 42 further comprising:

means for providing predetermined time intervals.

44. The apparatus in accordance with claim 39, wherein said AC-signal disruptions are caused by magnetic saturation in said powered networking system wherein said magnetic saturation is induced by said DC-current.

45. An apparatus in accordance with claim 36, wherein said predetermined characteristic of said AC-signal is at least one of a voltage amplitude and a corresponding energy charge of said AC-signal.

46. An apparatus in accordance with claim 36, wherein said comparing determines if said predetermined characteristic of said AC-signal is outside a predetermined range so that there is AC-signal disruption in said powered networking system.

47. A detector system for detecting a signal disruption of an AC-signal by a DC-current in a powered networking system, said system comprising:

a signal analyzer subsystem in operative electrical communication with said powered networking system, said analyzer adapted to receive said AC-signal from said networking system and to analyze said AC-signal based on a predetermined characteristic of said AC-signal and to generate an analyzer output;

a comparator subsystem in operative electrical communication with said analyzer subsystem, said comparator adapted to receive and to compare said analyzer output with a predetermined reference source so as to detect an AC-signal disruption; and wherein said AC-disruptions are caused by a magnetic saturation in said powered networking system wherein said magnetic saturation is induced by said DC-current.

48. A method for detecting a signal disruption of an AC-signal by a DC-current in a powered networking system, said method comprising:

receiving an AC-signal from said networking system;

analyzing said AC-signal based on a predetermined characteristic of said AC-signal generating an analysis output responsive to said analyzing;

comparing said analysis output with a predetermined reference source to detect said AC-signal disruption in the powered networking system; and wherein said AC-disruptions are caused by a magnetic saturation in said powered networking system wherein said magnetic saturation is induced by said DC-current.

* * * * *